United States Patent [19]

Miller

[11] 4,137,116

[45] Jan. 30, 1979

[54] METHOD OF MAKING A PRESSURE SWITCH

[75] Inventor: Norman K. Miller, Concordville, Pa.

[73] Assignee: Miller Brothers, Concordville, Pa.

[21] Appl. No.: 789,807

[22] Filed: Apr. 22, 1977

[51] Int. Cl.[2] ..... H01H 3/02

[52] U.S. Cl. ..... 156/269; 29/622; 29/625; 156/292; 156/301; 156/302; 156/306; 156/324; 200/85 A; 200/86 R; 428/72; 428/138; 428/194; 428/200; 428/209; 428/313

[58] Field of Search ..... 200/86 R, 85 R, 85 A; 53/39, 41; 156/269, 290, 301, 302, 309, 251, 292, 324, 303, 306; 428/313, 138, 194, 209, 200, 72; 29/625, 627, 622

[56] References Cited

U.S. PATENT DOCUMENTS

| | | | |
|---|---|---|---|
| 3,398,036 | 8/1968 | Viesturs | 156/290 |
| 3,540,963 | 11/1970 | Dipner | 156/290 |
| 3,616,039 | 10/1971 | Hutzler et al. | 156/309 |
| 3,617,666 | 11/1971 | Braue | 200/86 R |
| 3,718,791 | 2/1973 | Swablowski | 200/86 R |
| 3,741,842 | 6/1973 | Joa | 156/269 |
| 3,749,866 | 7/1973 | Tiazkun et al. | 200/85 A |
| 3,830,991 | 8/1974 | Durocher | 200/86 R |
| 3,920,940 | 11/1975 | Brown et al. | 200/86 R |
| 3,933,555 | 1/1976 | Downey | 156/251 |
| 4,037,069 | 7/1977 | Gonzales et al. | 200/86 R |
| 4,065,649 | 12/1977 | Carter et al. | 200/86 R |
| 4,076,872 | 2/1978 | Lewicki et al. | 428/72 |
| 4,090,045 | 5/1978 | Marsh | 200/86 R |

FOREIGN PATENT DOCUMENTS

| | | | |
|---|---|---|---|
| 968211 | 9/1964 | United Kingdom | 200/86 R |

*Primary Examiner*—Jerome W. Massie
*Attorney, Agent, or Firm*—Robert K. Youtie

[57] ABSTRACT

A pressure switch and method of manufacture wherein a resiliently yieldable intermediate open layer is sandwiched between flexible conductive layers, all of which is enclosed between flexible outer layers, so that in the unstressed or relatively unstressed condition the contact layers are spaced apart by the intermediate layer, while flexure or other sufficient stressing of the assembly effects contact of the contact layers through the open intermediate layer.

3 Claims, 6 Drawing Figures

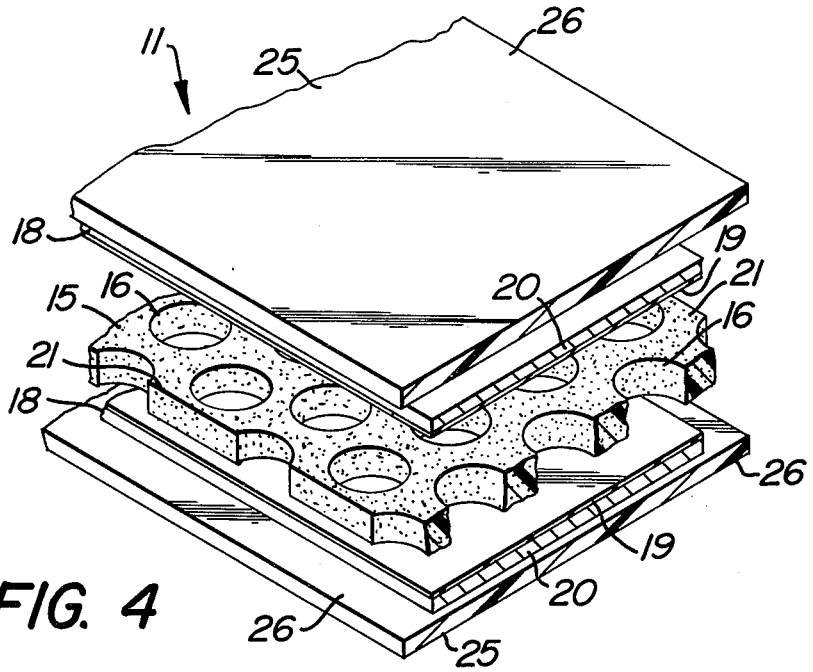
FIG. 4
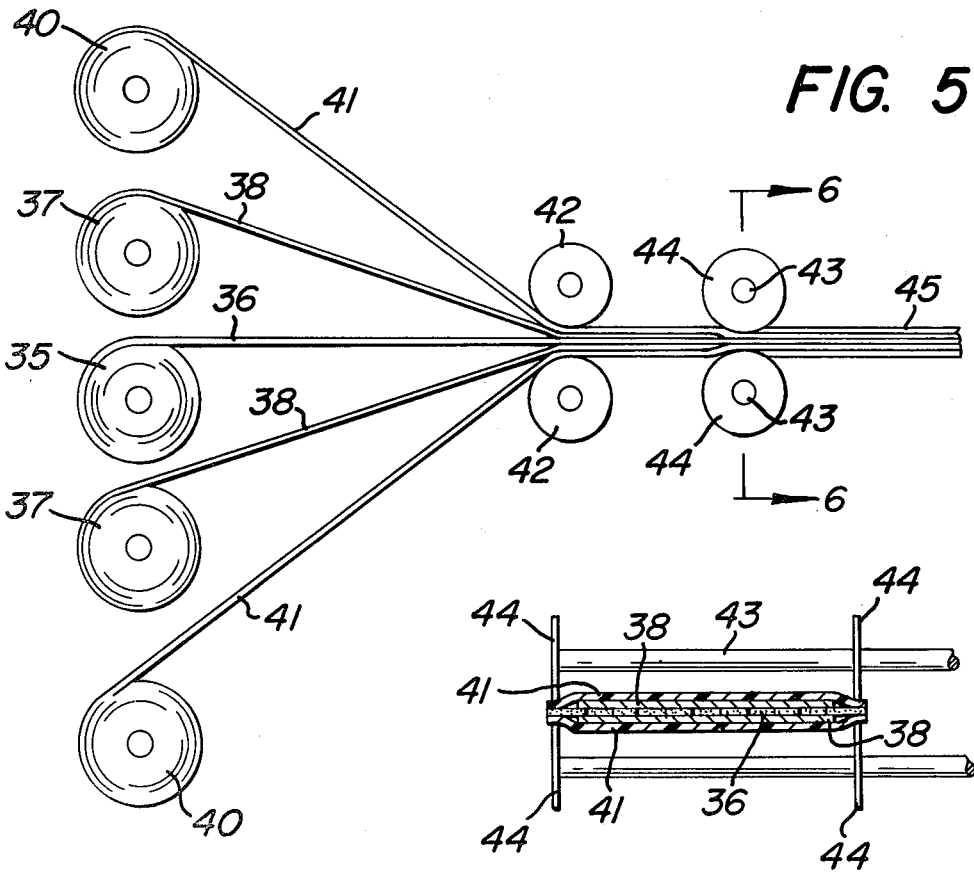
FIG. 5
FIG. 6

METHOD OF MAKING A PRESSURE SWITCH

BACKGROUND OF THE INVENTION

While the switch structure and manufacturing method of the present invention have been primarily developed and employed for use in vehicle seating, as to sense the weight of an occupant, and will be described hereinafter with particular reference thereto, it is appreciated that the advantageous results of the instant invention are well adapted for use in a variety of different type switches and their manufacture. More specifically, occupant sensing seating switches are sometimes called "flexible switches", being operative to open or close upon being flexed. Such switches have heretofore required relatively expensive components, necessitating slow and expensive assembly procedures, and resulting in extremely high unit costs. Further, prior art flexible switches were extremely limited in versatility, so as to be highly specialized and lacking general marketability.

SUMMARY OF THE INVENTION

By the instant invention there is provided a flexible switch and method of manufacture which utilizes readily available component parts and permits of substantially automatic continuous manufacture to achieve substantial savings in cost and economically justify wide versatility in use, in a variety of pressure switch environments, for example as elongate signal switches in mass transportation vehicles, safety switches for movable closures, and others.

It is a further object of the present invention to provide a pressure switch construction and method of manufacture having the advantageous characteristics mentioned in the preceding paragraph, wherein switch characteristics may be selected according to specified requirements, as by selectively varying the thickness of foam, resilience thereof, ratio of open area to overall size, and others.

It is another object of the present invention to provide a pressure switch construction and method of manufacture of the type described wherein manufacture is extremely simple requiring only a pair of securements or welds between the innermost and outermost layers, the contact layers being admirably well held in position within pockets so as to require no other securement or attachment.

It is still a further object of the present invention to provide a pressure switch construction which is capable of manufacture in substantially any size and shape, achieving any desired degree of sensitivity, permitting of substantial savings and costs, and resulting in switches of greatly enhanced durability and lengthened useful life.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description and of which the scope will be indicated by the appended claims.

BRIEF DESCRIPTION OF THE DRAWINGS

FIG. 4 is an exploded perspective view showing the interior construction of a pressure switch of the present invention, illustrating the several layers thereof in enlarged detail.

FIG. 5 is a diagrammatic representation of the switch manufacturing method of the present invention.

FIG. 6 is a sectional view taken generally along the line 6—6 of FIG. 5.

DESCRIPTION OF THE PREFERRED EMBODIMENT

Figure 1:
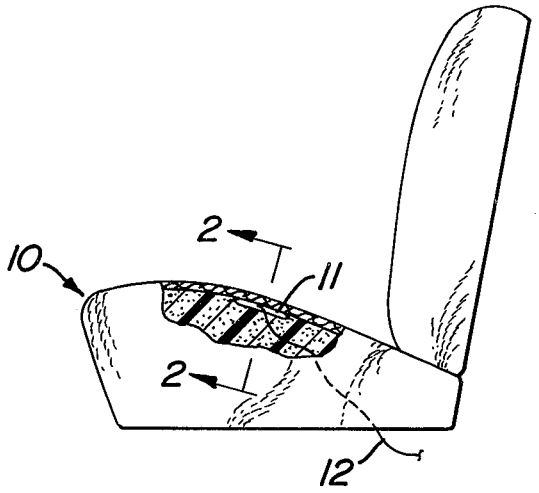
FIG. 1 is a side elevational view showing an occupant responsive switch of the present invention in a seat, broken away to illustrate interior construction.

Referring now more particularly to the drawings, and specifically to FIG. 1 thereof, a seat is there generally designated 10, and may be the seat of a vehicle, say an automobile, ride-on mower or other seat in which it is desired to assure occupancy to maintain an electric circuit operating. Located in the seat, say directly below the occupant position, may be a pressure switch 11 connected by suitable conductor means 12 in a desired electric circuit.

Figure 2:
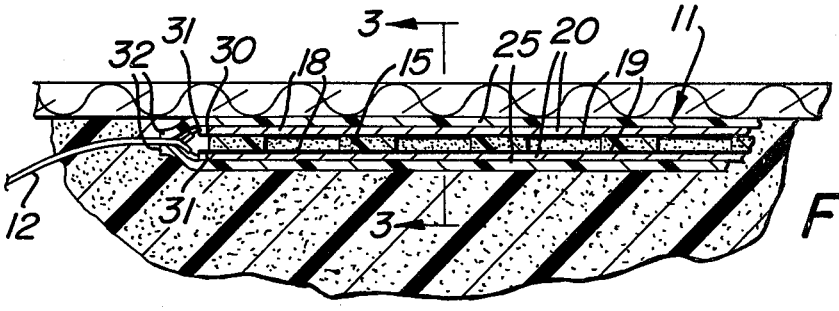
FIG. 2 is a partial sectional view, enlarged for clarity, taken generally along the line 2—2 of FIG. 1.
Figure 3:
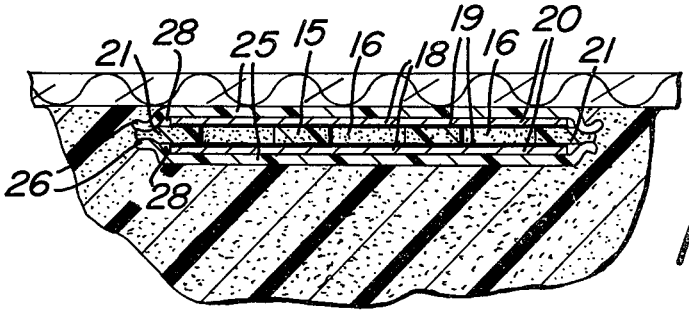
FIG. 3 is a sectional view taken generally along the line 3—3 of FIG. 2.

The pressure switch 12 is best shown in FIGS. 2, 3 and 4, the latter figure illustrating the several laminae thereof in greater detail.

For example, the innermost or intermediate layer or lamina 15 is advantageously of a dielectric or insulating material, such as foam, having resiliently yieldable deflectability and normally assuming a generally flat distended condition. Several of the plastic foams may be employed, as desired, to obtain the requisite resilience and insulating characteristics. The intermediate foam layer 15 is advantageously of a perforate or open construction, as by through holes or reticulations 16. The specific resilience of the foam intermediate layer 15, and the size of openings 16, or the ratio of open area to overall area may be judiciously selected to achieve the desired resilient compressibility and flexibility for requisite pressure switch characteristics, as will appear more fully hereinafter.

On opposite sides of and in facing relation with respective faces of the intermediate foam layer 15 are a pair of contact layers 18. The contact layers 18 may each include an inner lamination 19 of conductive sheet material, such as aluminum foil, and an outer lamination of flexible backing material, such as woven asbestos 20. A conductor structure such as disclosed in U.S. Pat. No. 3,407,263 of Norman K. Miller has been found satisfactory.

Of course, the conductor layers 18 are relatively flexible with their conductive faces 19 facing toward the intermediate layer 15 and toward each other through the openings 16 of the intermediate layer. The lateral dimensions or width of the conductive layers 18 may be substantially equal to each other, and less than the lateral dimension or width of the intermediate layer 15, so that the longitudinal edge margins 21 of the intermediate layer extend laterally oppositely outwardly beyond the adjacent facing conductive layers 18.

It will therefore be appreciated that the conductive layers 18 combine in a sandwiching relation with the intermediate layer 15 with opposite edge margins of the latter extending outwardly beyond the former.

Outwardly of the sandwich of conductive layers 18 and intermediate layer 15, there are a pair of non-conductive or insulating flexible outer layers or sheets 25.

The outer or enclosure layers 25 may be of flexible plastic sheeting, and have their longitudinal margins or side edges 26 extending oppositely outwardly beyond the conductor layers 18 and may be substantially coterminous with the longitudinal side edges 21 of the intermediate layer 15.

The pressure switch 11 is better shown, overall, in FIGS. 2 and 3. It will there by observed that, in the transverse sectional view of FIG. 3, the intermediate foam layer 5 has its longitudinal marginal edges 21 extending laterally beyond the longitudinal or side edges of conductive layers 18. Further, the outer or enclosure layers 25 have their longitudinal edge margins 26 generally laterally coterminous with the edge margins 21 of the intermediate layer 15, and therefore also extend laterally beyond the conductive layers 18. It is the laterally extending marginal edge portions 21 and 26 of the intermediate layer 15 and outer enclosure layers 25 that are secured or sealed together in the assembled unit, as best seen in FIG. 3. The securement of overlying margins 21 and 26 may be by any suitable means, such as adhesive, heat sealing, radio frequency welding, or other suitable securing means.

It will therefore now be appreciated that there is defined in the space between each outer enclosure layer or sheet 25 and the intermediate layer or sheet 15 a generally flat receptacle or pocket, as at 28, substantially conformably receiving and effectively positioning a respective conductive layer 18. Thus, the conductive layers 18 substantially fully occupy the respective pockets 28 and are maintained in position therein without otherwise positive securement, attachment or the like, which greatly simplifies assembly, eliminates or minimizes the possibility of damage to the conductor sheets, and effects substantial savings in manufacturing costs.

In manufacture in accordance with the instant invention, the hereinbefore described assembly of FIG. 3 may be substantially continuously produced, as will be set forth hereinafter in greater detail, and subsequently severed to desired lengths. The end of one such length is shown in FIG. 2, wherein the end edge of intermediate layer 15, as at 30, may terminate short of the adjacent end edges 31 of conductive layers 18. Further, the conductive layer end edges 31 may terminate short of the end edges 32 of the outer layers 25. As illustrated in FIG. 2, the conductors 12 may be electrically connected to conductive layers 18, and pass exteriorly of the switch 11 between the end edges 32 of the enclosure layers 25. Thus the peripheral margins of the enclosure layers 25 are suitably sealed together except for sealed passage therebetween of the conductors 12.

Of course, upon compression of the assembled pressure switch 11, the contact layers 18 will meet and engage through one or more of the openings 16 to actuate or deactuate a circuit, as desired. Flexure of the switch 11 also results in compression of the intermediate layer 15 and contacting engagement therethrough of the conductive layers 18.

Referring now to FIGS. 5 and 6, wherein are shown applicant's instant method and apparatus for manufacture. A plurality of supply sources or reels are shown as passing webs into facing relation with each other. More particularly, an intermediate reel or coil 35 feeds a web 36 of open or perforated foam, while an adjacent pair of supply reels 37 each feed a web 38 of flexible conductive sheet material. The web 36 may be the same material as intermediate layer 15, while the webs 38 may be of the same material as conductive layers 18. Additionally, a pair of reels 40 may be provided respectively feeding webs 41 of flexible insulating sheet material, such as the plastic sheeting of enclosure layers 25. The several webs 36, 38 and 41 are guided into superposed facing relation between guide rolls 42, with the conductive webs 38 in facing engagement with and on opposite sides of intermediate layer 36, and the flexible enclosure webs 41 outwardly of and on opposite outer sides of respective conductive webs 38.

The intermediate web 36 may be of a lateral dimensional width greater than that of conductive webs 38, so as to have its longitudinal margins projecting laterally outwardly beyond the side edges of the conductive webs. Also, the lateral dimensions of the outer enclosure webs 41 may be greater than those of the conductive webs 38, say approximately equal to the lateral dimension of the intermediate web 36.

In superposed facing engagement, as described above, the several webs proceed through guide rolls 42 and through the nip of sealing rolls 43. Between rolls 43, as best seen in FIG. 6, the rolls may have enlarged end portions or heads 44 serving to seal therebetween the laterally extending longitudinal edge margins of intermediate web 36 and outer or enclosure webs 41. The sealing between the roll heads 44 may be thermal, radio frequency or other suitable sealing securement.

The sealed assembly proceeds downstream, as at 45, from the sealing rolls 43, and may then be severed for assembly into a plurality of pressure switches 11 by closing the ends of the severed lengths.

From the foregoing, it is seen that the present invention provides a pressure switch and method of manufacture which are extremely efficient and economical, resulting in a pressure switch of great durability and reliability at relatively low cost.

Although the present invention has been described in some detail by way of illustration and example for purposes of clarity of understanding, it is understood that certain changes and modifications may be made within the spirit of the invention.

What is claimed is:

1. In the manufacture of flexible switch means, the steps which comprise: continuously feeding an intermediate open work web of resiliently yieldable sealable insulating material, continuously feeding a pair of flexible conductive webs of less width than and into facing relation with opposite faces of said open work web simultaneously with feeding of the latter, simultaneously feeding a pair of flexible non-conductive sealable outer webs of greater width than and into facing relation with opposite outer faces of respective conductive webs, and sealing adjacent longitudinal edges of said outer webs outwardly beyond said conductive webs to projecting longitudinal edge portions of said open work web with said conductive webs remaining unsealed, whereby said conductive webs are each retained in position by and between said open work web and a respective outer web without additional securement.

2. The method according to claim 1, further characterized in severing predetermined lengths of the sealed assembly, and closing the ends of said predetermined lengths to define thereof sealed switch units.

3. The method according to claim 1, wherein said sealing of said open work margins and outer web margins is by welding.

* * * * *